US009500427B1

(12) United States Patent
Larue

(10) Patent No.: US 9,500,427 B1
(45) Date of Patent: Nov. 22, 2016

(54) FIREARM SOUND AND FLASH SUPPRESSOR HAVING LOW PRESSURE DISCHARGE

(71) Applicant: Mark C. Larue, Leander, TX (US)

(72) Inventor: Mark C. Larue, Leander, TX (US)

( * ) Notice: Subject to any disclaimer, the term of this patent is extended or adjusted under 35 U.S.C. 154(b) by 0 days.

(21) Appl. No.: 14/927,367

(22) Filed: Oct. 29, 2015

(51) Int. Cl.
*F41A 21/30* (2006.01)
*F41A 21/34* (2006.01)
*F41A 21/28* (2006.01)

(52) U.S. Cl.
CPC ..... *F41A 21/30* (2013.01); *F41A 21/28* (2013.01); *F41A 21/34* (2013.01)

(58) Field of Classification Search
CPC ..... F41A 21/00; F41A 21/30; F41A 21/28; F41A 21/32; F41A 21/325; F41A 21/34
USPC ..... 89/14.4
See application file for complete search history.

(56) References Cited

U.S. PATENT DOCUMENTS 1,017,003 A * 2/1912 Kenney ..... F41A 21/30 181/223
2,351,037 A * 6/1944 Green ..... F41A 21/34 89/14.5
2,503,491 A * 4/1950 Janz ..... F41A 21/30 181/223
2,696,995 A * 12/1954 Schacht ..... F41A 21/325 285/392
4,510,843 A * 4/1985 Rabatin ..... F41A 21/325 89/14.4
6,385,891 B1 * 5/2002 Rabatin ..... F41A 21/325 42/77
8,387,299 B1 * 3/2013 Brittingham ..... F41A 21/30 42/90
8,511,425 B2 * 8/2013 Larue ..... F41A 21/30 181/223
8,516,941 B1 * 8/2013 Oliver ..... F41A 21/30 181/223
8,807,272 B2 * 8/2014 Bladen ..... F41A 21/30 181/223
8,844,422 B1 * 9/2014 Klett ..... F41A 21/30 89/14.2
8,939,057 B1 * 1/2015 Edsall ..... F41A 21/30 181/223
8,967,325 B1 * 3/2015 Cronhelm ..... F41A 13/00 181/223
9,347,727 B1 * 5/2016 Cler ..... F41A 21/30
2010/0275493 A1 * 11/2010 Polovnev ..... F41A 21/34 42/90
2012/0103176 A1 * 5/2012 Latka ..... F41A 21/30 89/14.4
2012/0152649 A1 * 6/2012 Larue ..... F41A 21/30 181/223
2012/0272818 A1 * 11/2012 Dueck ..... F41A 21/30 89/14.4
2013/0319790 A1 * 12/2013 Bladen ..... F41A 21/30 181/223
2014/0020976 A1 * 1/2014 Shults ..... F41A 21/30 181/223
2014/0237881 A1 * 8/2014 Mack ..... F41A 21/325 42/90
2015/0192379 A1 * 7/2015 Larson, Jr. ..... F41A 21/36 89/14.3
2015/0260472 A1 * 9/2015 Smith ..... F41A 21/30 89/14.2
2016/0097609 A1 * 4/2016 Penchuk ..... F41A 21/325 42/76.01
2016/0202013 A1 * 7/2016 Lessard ..... F41A 21/325 89/14.3

* cited by examiner

*Primary Examiner* — Bret Hayes
*Assistant Examiner* — Derrick Morgan
(74) *Attorney, Agent, or Firm* — James L. Jackson

(57) ABSTRACT

A firearm noise suppressor and flash hider device having a tubular housing having left hand threaded components. A suppressor mount securing and aligning the tubular housing relative to a firearm barrel. A number of propellant gas handling members within the housing define aligned projectile ports and baffle chambers to permit projectile movement and slow the progress of propellant gas as it traverses the internal chamber. These gas handling members define primary and secondary flow paths within the housing to divide the propellant gas discharge from the barrel and minimize gas pressure and volume of flow, resulting in lower propellant pressure, minimized noise and propellant flash. The primary and secondary flow paths each have separate discharge openings at the forward end of the suppressor.

22 Claims, 9 Drawing Sheets

FIREARM SOUND AND FLASH SUPPRESSOR HAVING LOW PRESSURE DISCHARGE

BACKGROUND OF THE INVENTION

1. Field of the Invention

The present invention is directed generally to sound suppressors that are designed for removable attachment to the threaded end of the barrel of a firearm, particularly a rifle. The present invention also concerns suppressors having the capability for suppressing the rather harsh sound of firearm discharge, but also substantially eliminating the rather bright flash that is generally projected from the bore of a firearm barrel when the firearm is discharged. More specifically, the present invention concerns a suppressor device that divides the propellant gas discharge of a firearm barrel into primary and secondary paths that have different discharge openings and serve to lower propellant gas pressure within the suppressor and minimize discharge sound and substantially eliminate propellant flash and minimize the potential for propellant gas blow-back toward the firearm user.

2. Description of the Prior Art

A significant number of firearm sound suppressor devices and flash suppressor devices, generally referred to as suppressors herein, have been developed over the years for use with firearms such as rifles, shotguns and handguns. In most cases the suppressors are attached to the barrel of a firearm, such as by threaded attachment. In some cases suppressors are constructed integrally with a firearm barrel so as to be a permanent component of the firearm.

Typically, a suppressor comprises an elongate tubular body that attaches in any suitable manner to a firearm barrel and provides for the movement of a projectile from the bore of a firearm barrel and through the tubular body of the suppressor. To facilitate sound suppression a number of internal baffles are typically positioned in stacked relation within a suppressor housing with baffle partitions disposed in axially spaced relation within the housing and with central openings in each baffle partition for projectile and propellant passage. A number of chambers that are defined between the internal baffles, causing the propellant gas to progress in serial fashion through the multiple chambers, with its velocity being diminished as it progresses. The partitions of the baffles are designed to reflect propellant gas and cause gas agitation within the chambers to slow the progress of gas transition through the suppressor and increase the dwell time and reduce the typically sharp and loud noise of the propellant gas being dischargeded from the suppressor. Propellant gas emitted from the bore of the barrel enters the much larger volume of the internal chamber of the tubular body and progresses serially from chamber to chamber, with the gas expanding and its pressure being diminished within each successive chamber.

When suppressors employ threaded connection between the various components the threads typically become fouled to the point that the threaded connections become difficult to separate. When the firearm is fired the suppressor housing is subjected to significant internal pressure which causes minute separation of the threaded connections and drive gunpowder residue into the threads, essentially causing locking of the threads which prevents them from being unthreaded, such as for cleaning. For this reason suppressors are typically manufactured by welding which prevents assembly and disassembly for cleaning of internal residue fouling and other service. When a welded suppressor device is employed, repeated firing of the firearm typically causes continuous fouling of the baffles, chambers and threads of the suppressor by accumulation of cartridge powder residue. Thus, when the threads of the suppressor or the threads of a firearm barrel become fouled it may be difficult or impossible to remove clean and reassemble the components of a suppressor device. This undesirable characteristic is common to most types of suppressors and represents a distinct disadvantage when servicing firearm components during field conditions. It often becomes necessary to return the suppressor to a repair or service facility to open the compressor and clean away cartridge powder deposits. It is desirable therefore, to provide a suppressor mechanism that effectively ensures isolation of the threaded connections that secure the suppressor components in assembly and at the same time provide for effective stability and durability of the suppressor mechanism and its connection with a rifle barrel.

Another disadvantage of firearm suppressor use is the problem of suppressor instability and the potential for coaxial misalignment that results from the threaded connection of the suppressor to the barrel of a firearm. The barrel of a firearm that is designed for attachment of a muzzle brake or suppressor is typically provided with a reduced diameter externally threaded section that is of fairly short length. An internally threaded section of a typical suppressor attachment end wall is also typically fairly short, thus causing the threaded connection to have minimal stability due to the typical length of the threaded connection of the suppressor with the firearm barrel. Thus, due to lateral impacts or other conditions a suppressor may become axially misaligned to the point that the edge of a moving bullet may contact an edge of a bullet port and interfere with the accuracy of an otherwise perfectly aimed shot. It is desirable to provide a suppressor mechanism that is exceptionally stable as well as protecting the internal threaded components from the undesirable characteristics of gunpowder residue buildup and fouling. U.S. Pat. No. 8,511,425 of Mark C. LaRue shows a suppressor device that employs a flash hider type device as a structural interface with a tubular suppressor housing. The flash hider structure shown in the '425 patent has spaced, angulated external support surfaces that are in engagement with corresponding spaced internal surfaces of a housing mount. This feature adds materially to the structural integrity of the coupling mechanism for securing a suppressor to the threaded end of a firearm barrel.

Typical commercially available firearm noise suppressors have multiple compartments within a single elongate, typically cylindrical tubular housing and define a single gas flow path. The baffles that are spaced within the suppressor housing create back-pressure within the suppressor that is relatively slow to be exhausted to the atmosphere. In many cases some residual gas pressure will remain within a suppressor at the time the auto-cycling mechanism of a gas energized firearm causes unlocking of the bolt member and begins to extract a spent cartridge case from the cartridge chamber of the firearm. When this condition exists a small amount of the residual propellant gas may be released from the bore of the firearm due to the back-pressure within the suppressor when unseating of a cartridge case begins, thereby directing a small amount of residual propellant gas toward the user of the firearm. This undesirable condition is known as "blow-back". The presence of propellant gas can be objectionable from the standpoint of the comfort of the user. It is desirable, therefore, to provide a firearm noise and flash suppressor that provides for enhanced propellant gas exhaust to ensure optimum discharge of propellant gas and minimum gas exhaust dwell time so that little if any residual propellant gas pressure exists within the suppressor and firearm barrel when spent cartridge case extraction begins.

Though most sound suppressors achieve significant reduction of sound emission, the presence of gunpowder flash being emitted from the forward end of suppressors has continued to be a significant problem. During tactical rifle firing activities gunpowder flash is typically projected about a foot from the forward end of most suppressors because the rather high internal pressure causes burning gunpowder to pass rapidly through the suppressor and to be projected from the suppressor before it is completely consumed. This flash is very bright and is readily seen by opposing personnel, thereby causing the opposing personnel to direct rifle fire at the flash, resulting in significant danger to the firearm user. It is desirable, therefore, to provide a sound suppressor for firearms that minimizes internal propellant gas pressure and also serves as a flash suppressor by permitting sufficient dwell time to cause complete combustion of the propellant within the suppressor housing so that virtually no gunpowder flash occurs externally of the suppressor.

Briefly, the present invention involves a firearm noise and flash suppressor having an elongate tubular housing having front and rear end portions and defining an internal suppressor chamber. A plurality of baffles and spacers are positioned within the internal suppressor chamber and define aligned central projectile and propellant gas ports and define a plurality of propellant gas processing chambers that reflect and agitate the gas and slow the progress of propellant gas flow through the suppressor. The pressure of propellant gas is diminished by dividing gas emitted from the firearm barrel into a primary flow path within the baffles and a secondary flow path between the outer walls of the baffles and the internal wall of the elongate tubular housing. As the propellant gas progresses toward the front end of the elongate tubular housing the gas within the primary flow path is concentrated and directed to the projectile and gas exhaust port. Simultaneously the propellant gas of the secondary flow path is directed toward the circular array of angulated gas exhaust passages by flow passage sections in the form of external slots or grooves of a gas concentration member or by flow passage sections defined by spacing of the external surfaces of the gas concentration member and the internal surface of the suppressor body. The primary and secondary flow paths minimize the internal pressure of propellant gas being discharged vis the central projectile and propellant gas discharge port and the array of angulated propellant gas discharge ports and ensure enhancement of the timing sequence of the suppressor, thus minimizing the sharpness of suppressor noise and also minimize the potential for the presence of a visible flash in front of the suppressor.

As mentioned above, most firearm suppressors have components that are assembled by welding or brazing to eliminate the problem of gunpowder residue fouling. Threaded suppressor assembly is preferable, because a suppressor mechanism can be disassembled and cleaned or internal parts can be replaced. However, it is known, especially when extremely high pressure ammunition is used, that gunpowder residue will be forced into threaded connections by the effects of high pressure and by pressure energized distortion of the suppressor housing. This residue will typically interfere with and often prevent disassembly of the threaded connections by firearm users. Often, special equipment will be needed to accomplish unthreading and separation of threaded components, thus requiring that the suppressor be transported to a special servicing facility. By minimizing the internal propellant gas pressure by means of the dual flow path feature of the present invention, the problem of gunpowder fouling is largely eliminated. Suppressors can be disassembled and cleaned under field conditions, thus permitting firearm users to quickly restore fouled suppressors to effective service conditions.

The suppressor of the present invention has components that are designed for threaded assembly. Moreover, the threads of the various components are preferably left handed threads so that the natural shock and vibration of firearm use will not tend to loosen the threaded connections.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is an isometric illustration showing a firearm sound and flash suppressor that is constructed according to the principles of the present invention and represents the preferred embodiment of the invention;

FIG. 2 is an elevation view showing the front end of the firearm sound and flash suppressor of FIG. 1;

FIG. 3 is an elevation view showing the rear end of the firearm sound and flash suppressor of FIG. 1;

FIG. 4 is a longitudinal section view showing a flash hider device being threaded onto the threaded end of a rifle barrel, the flash hider device serving as a mounting and alignment stabilizing component of the suppressor of FIG. 1;

FIG. 4A is a longitudinal section view showing the flash-hider type suppressor mount being separated from the suppressor device;

FIG. 5 is a partial longitudinal section view showing the rear or projectile and propellant gas inlet portion of the sound and flash suppressor of FIG. 1, being enlarged to illustrate the structure in detail;

FIG. 6 is a partial longitudinal section view showing an intermediate portion of the projectile and propellant gas inlet portion of the sound and flash suppressor of FIG. 1 in detail;

FIG. 7 is an enlarged partial longitudinal section view showing the front or projectile and propellant gas discharge portion of the sound and flash suppressor of FIG. 1;

Figure 8:
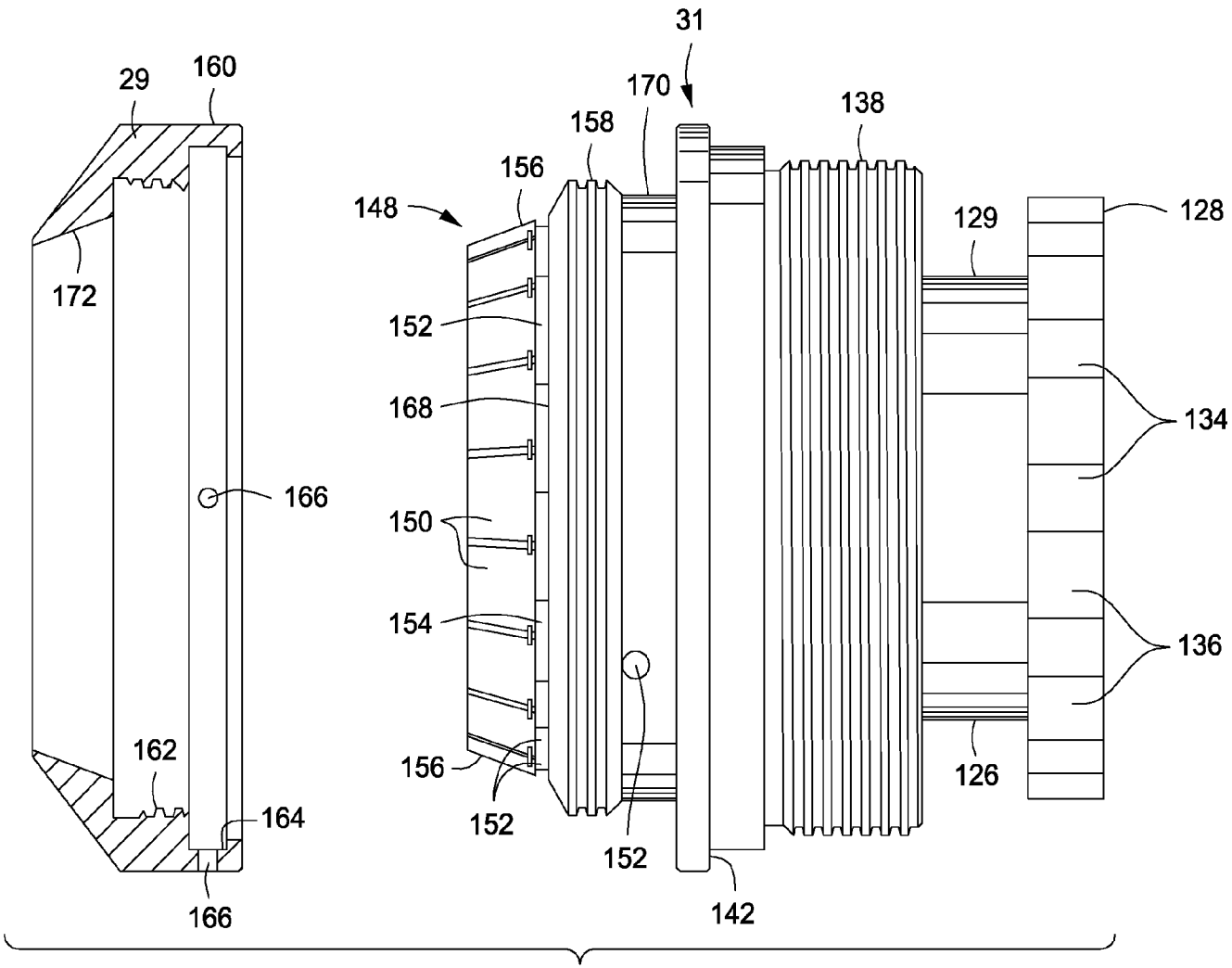
Figure 9:
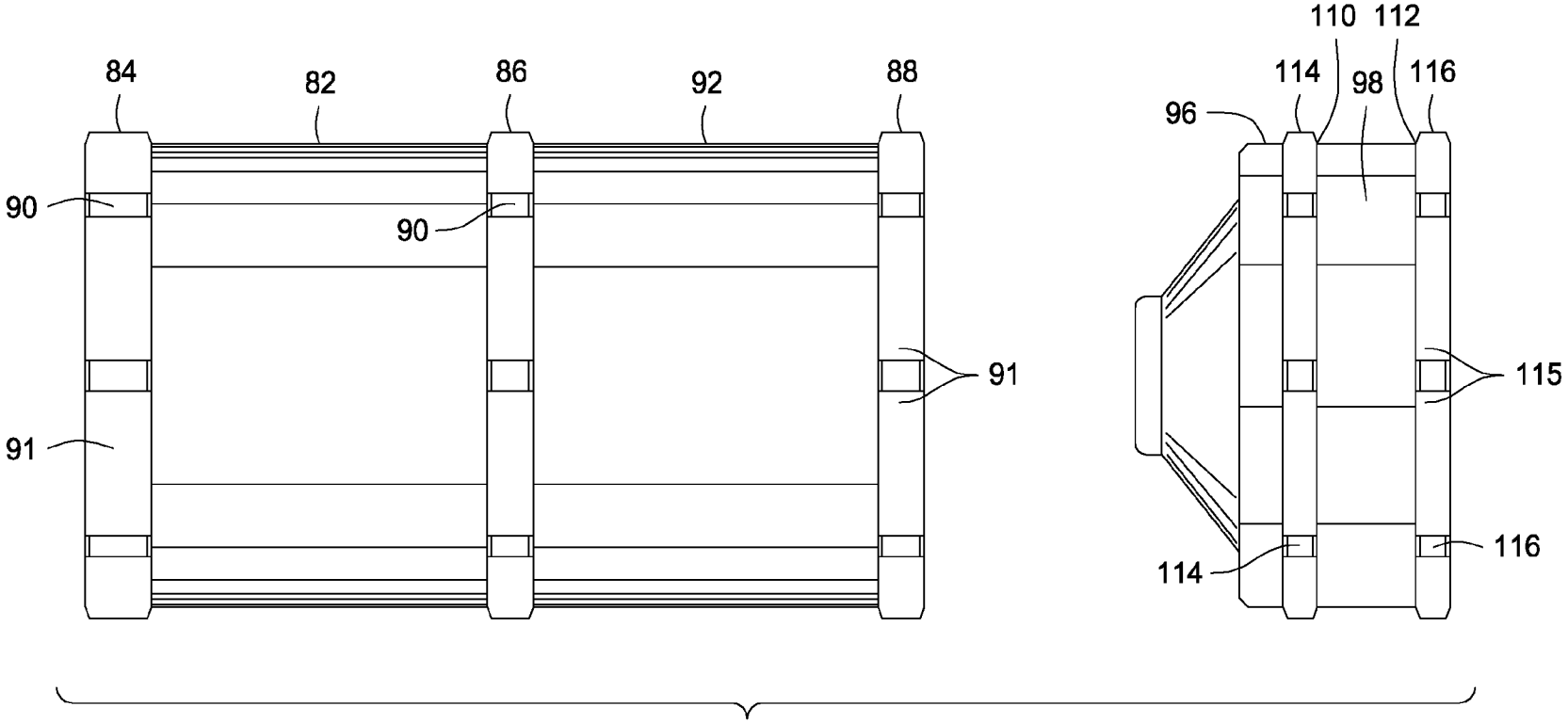

FIG. 8 is an exploded side elevation view showing a suppressor body structure which serves as a mount body and housing tube support and defines a collet-like clamp structure and showing a clamp actuating cap member for actuating clamp fingers of the collet-like clamp structure; and FIG. 9 is an exploded side view showing an internal spacer member and one of the internal baffle members of the suppressor assembly of FIGS. 1-4 in separated relation and showing external circular ridges and spaced external projections for defining a secondary flow passage within the suppressor housing and externally of the internal baffles and spacers within the suppressor.

DETAILED DESCRIPTION OF PREFERRED EMBODIMENT

Figure 1:
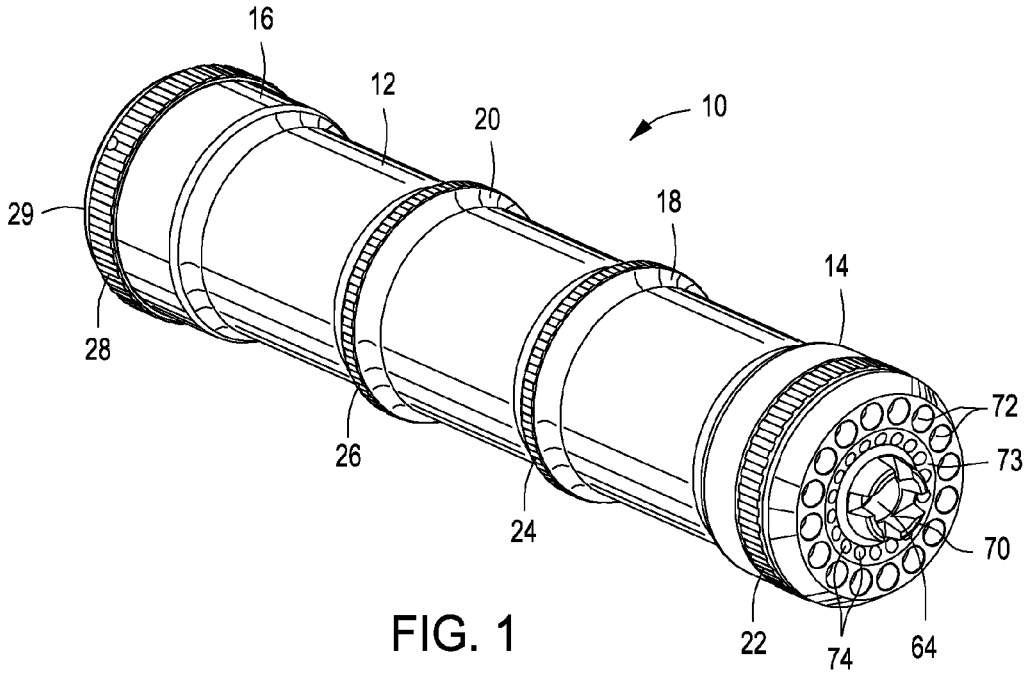
Figure 2:
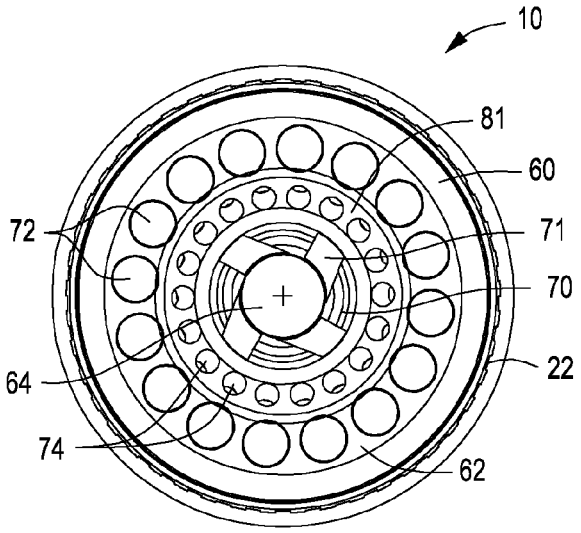
Figure 3:
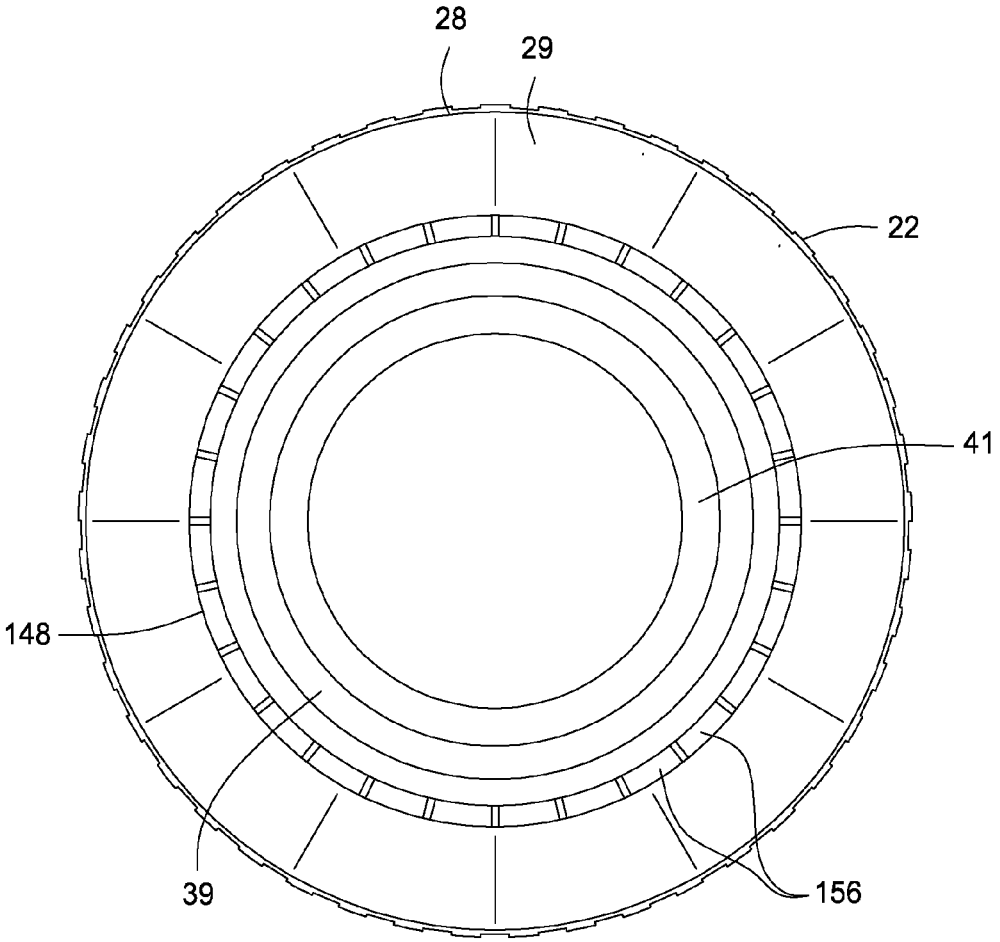
Figure 5:
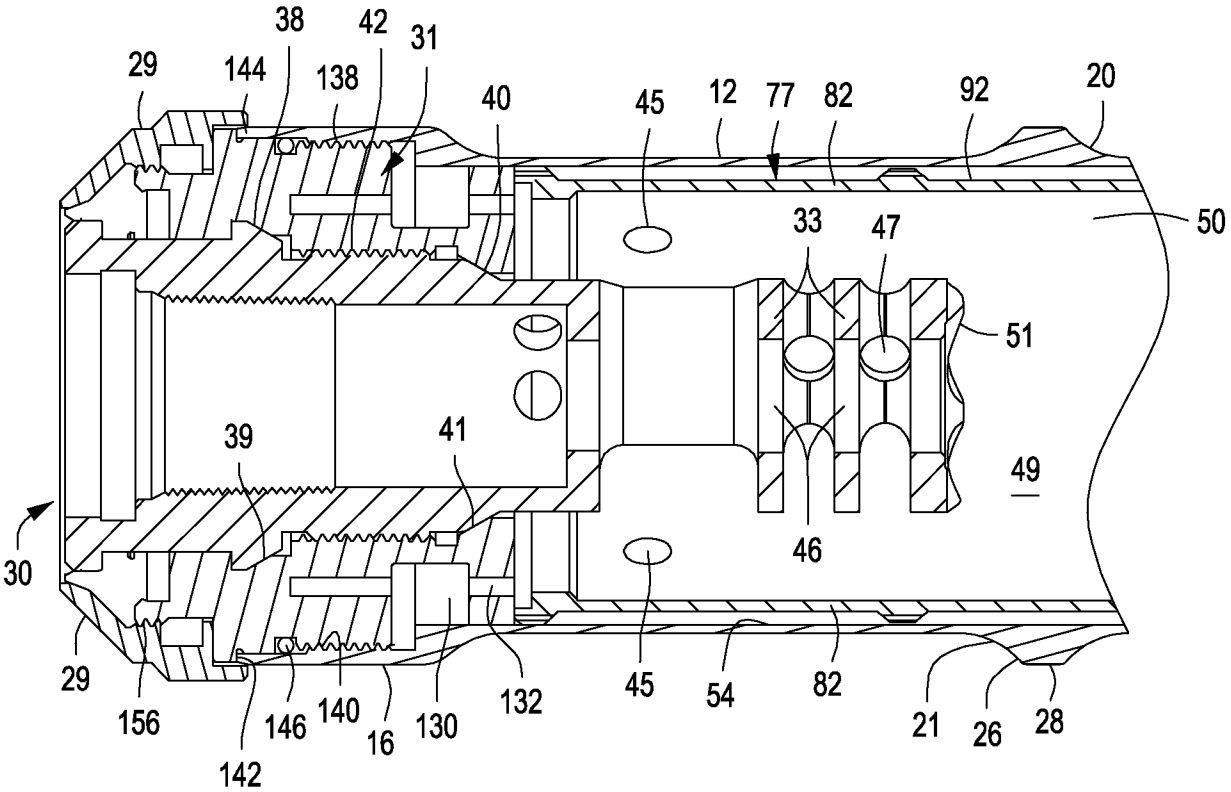

Referring now to the drawings and first to FIG. 1, a sound and flash suppressor device embodying the principles of the present invention is shown generally at 10 and incorporates an elongate tubular housing 12 having a defined length. The tubular housing 12 is strengthened at its forward and rear ends by generally cylindrical thickened enlarged housing wall sections 14 and 16 and is strengthened intermediate its extremities by annular external bosses 18 and 20 having curved side edges 21. Circular knurled regions 22, 24 and 26 are defined by the forward enlarged housing wall section and by the intermediate annular bosses 18 and 20. Another circular knurled section 28 is defined by a circular retainer cap 29 that is mounted to the rear end portion of the sound and flash suppressor assembly 10, the knurled sections being provided to facilitate secure manual grasping of the suppressor device when attaching it to or removing it from the barrel of a firearm, As shown in detail in FIG. 5, a suppressor mount and alignment member is shown generally at 30 and has the form of a flash hider device that can be mounted to a firearm barrel and used independently. The suppressor mount and alignment member establishes connection, support and alignment relation with a suppressor body member shown generally at 31. The suppressor mount and alignment member 30 defines a barrel end receptacle 32 having an internally threaded section 34 that is adapted to be threaded to the reduced diameter externally threaded section end section 35 of a firearm barrel 37. The suppressor mount and alignment member 30 is shown in FIG. 5 as being separated from a suppressor body structure 30 and mounted to a firearm barrel. The suppressor mount and alignment member 30 also defines a circular barrel receptacle geometry 36 which is of greater diameter than the externally threaded section 34 and receives the unthreaded end or muzzle portion of the firearm barrel 37 in closely fitting and suppressor stabilizing relation. The suppressor mount and alignment member 30 defines an external sealing section having axially spaced external annular tapered sealing surfaces 38 and 40 of differing diameter, with an externally threaded section 42 located between the annular tapered sealing surfaces.

The suppressor mount and alignment member 30 defines a tubular extension 44 having a plurality of internal transverse partitions 33 that define aligned projectile ports 46 through which a bullet or other projectile that has been propelled through the bore of a firearm barrel passes when an ammunition cartridge has been fired. The wall structure of the tubular extension 44 defines multiple lateral perforations such as shown at 48, permitting propellant gas to be discharged laterally from the tubular extension 44 into the first and largest of a plurality of internal compartments that each define portions of a primary flow path 50. One or more ports 47 of the tubular extension 44 communicate propellant gas from the barrel end receptacle 32 of the suppressor mount and alignment member 30 to the gas receiving internal compartment or chamber 49 that defines a portion of a primary flow path 50 through the suppressor device 10. The tubular extension of the suppressor mount 30 defines a front face 51 having a gas reflecting geometry that reflects the high pressure propellant gas in various directions rather than reflecting it directly back. This feature assists in causing agitation of the gas with the first chamber 49 of the primary flow path, creating gas turbulence that slows progress of the gas flow along the primary flow path and enhances the dwell time of gas processing within the suppressor.

The elongate tubular housing 12 is an integral or unitary structure having an enlarged structurally enhanced generally cylindrical rear end section 52 that has threaded connection at 54 with the suppressor body 31. Structural enhancement of the end section 52 results from thickened wall structure and from a smoothly curved transition fillet 54 that merges with the relatively thin cylindrical wall structure of the tubular housing and with the larger and thicker wall structure of the cylindrical rear end section 52. The elongate tubular housing 12 defines a generally cylindrical internal wall surface 54. Structural enhancement of the elongate tubular housing 12 also results from the strengthening band effect of the integral annular externally projecting bosses 18 and 20 and the strengthening and smooth force transition effect of the smoothly curved side edges 21 of the annular external bosses 18 and 20. The enlarged structurally enhanced generally cylindrical front end section 14 of the tubular housing 12 is rendered structurally enhanced by the presence of a smoothly curved transition fillet 56 and by the greater thickness of the wall structure of the generally cylindrical front end section 14 of the tubular housing.

A tubular extension 58 of a front closure member 60 is secured within the front end section 14 of the tubular housing 12 by means of a thread connection 62 and further strengthens the suppressor housing. The thread connection 62 is preferably a left hand thread connection so that counter-clockwise rotation of the front closure member 60 causes tightening of the thread connection and makes the thread connection more stable as well as minimizing the potential for thread loosening during use of the suppressor. The front closure member defines an annular seal groove 64 within which a seal member is secured to establish a positive pressure tight seal between the front closure member and the front end section of the tubular housing. The front closure member 60 further defines a central projectile and propellant port 66 through which a projectile such as a bullet passes and through which part of the propellant gas as it is controllably discharged from the suppressor. A plurality of spaced projections 68 of flash reducing geometry extend forwardly from the front wall 70 of the front closure member 60 and define slots 71 that open forwardly and laterally to direct exhaust gas forwardly and laterally. A tool such as a screwdriver shaft may be placed through the spaced slots 71 to forcibly rotate the front closure member to tighten or loosen it with respect to the front end section of the tubular housing. A circular array of recesses 72 are formed in the front wall 62 of the front closure member and serve to eliminate some of the material of the front wall structure. The recesses 72 also provide for engagement of a spanner type tool with the front wall structure if needed to rotate the front closure member during assembly and disassembly of the suppressor mechanism.

Multiple angulated gas exhaust passages 74 are formed in the front wall structure 62 and have communication with an internal annular gas conducting chamber 76 that is defined by contact of a circular rim 78 of a propellant gas concentration member 79 with a generally planar rear surface 80 of the front wall structure 62. The exhaust passages 74 terminate at exhaust openings or ports that are located within an annular contoured depression or groove 81 that faces forwardly from the front closure member 60. The propellant gas concentration member 79 is one of a plurality of propellant gas handling members, shown generally at 77, that are located within the propellant gas receiving chamber 50 of the tubular housing 12 and serve generally to mechanically process the propellant gas as it is conducted through the suppressor device. Other propellant gas handling members and their order of longitudinally stacked arrangement are shown in FIGS. 4 and 6-9. In the longitudinal section view of FIG. 4 a tubular spacer member 82 is positioned within the tubular housing 12 and defines annular outwardly projecting rib members 84, 86 and 88 that serve to strengthen the wall structure of the tubular spacer member. Each of the annular rib members define outwardly projecting spaced positioning members 90 that engage the internal cylindrical surface 54 of the tubular housing member 12 and position the tubular spacer member in centralized relation within the tubular housing. The outwardly projecting spaced positioning members 90 serve to maintain the external cylindrical surface 92 in spaced relation with the cylindrical internal surface 54 of the tubular housing 12 and define flow passage sections 91 that cooperatively define a secondary propellant gas flow passage 94 between the tubular spacer member and the internal surface of the tubular housing. The internal chamber 50 serves as part of a primary propellant gas flow passage or path centrally within the tubular housing 12 and through the tubular spacer member 82 and other propellant gas handling members that are positioned in longitudinally stacked relation within the suppressor housing 12. The tubular spacer member 82 or any of the baffle members 96 may define propellant gas transfer ports 89 as needed to ensure adequate transfer of propellant gas from the rear portion of the primary gas flow path to the secondary gas flow path that is defined by the annular space between the external surfaces of the tubular spacer member 82 and the internal surface 54 of the tubular housing 12.

Figure 4:
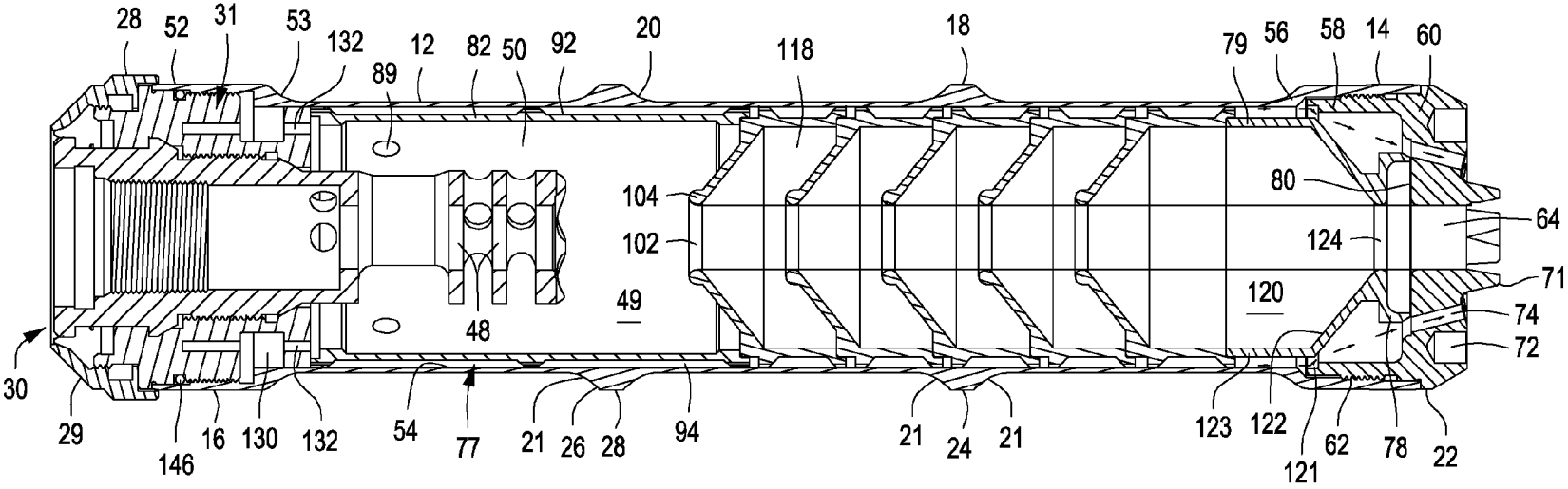
Figure 4A:
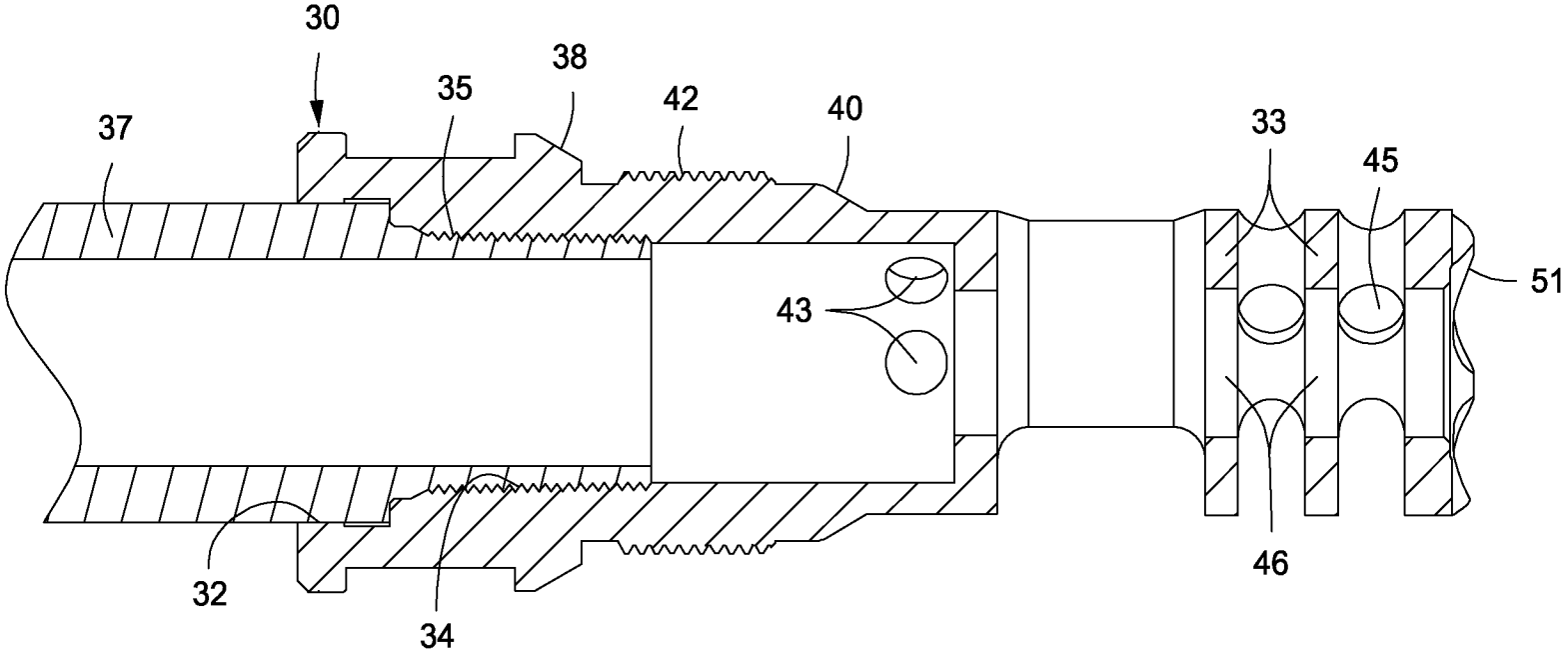
Figure 6:
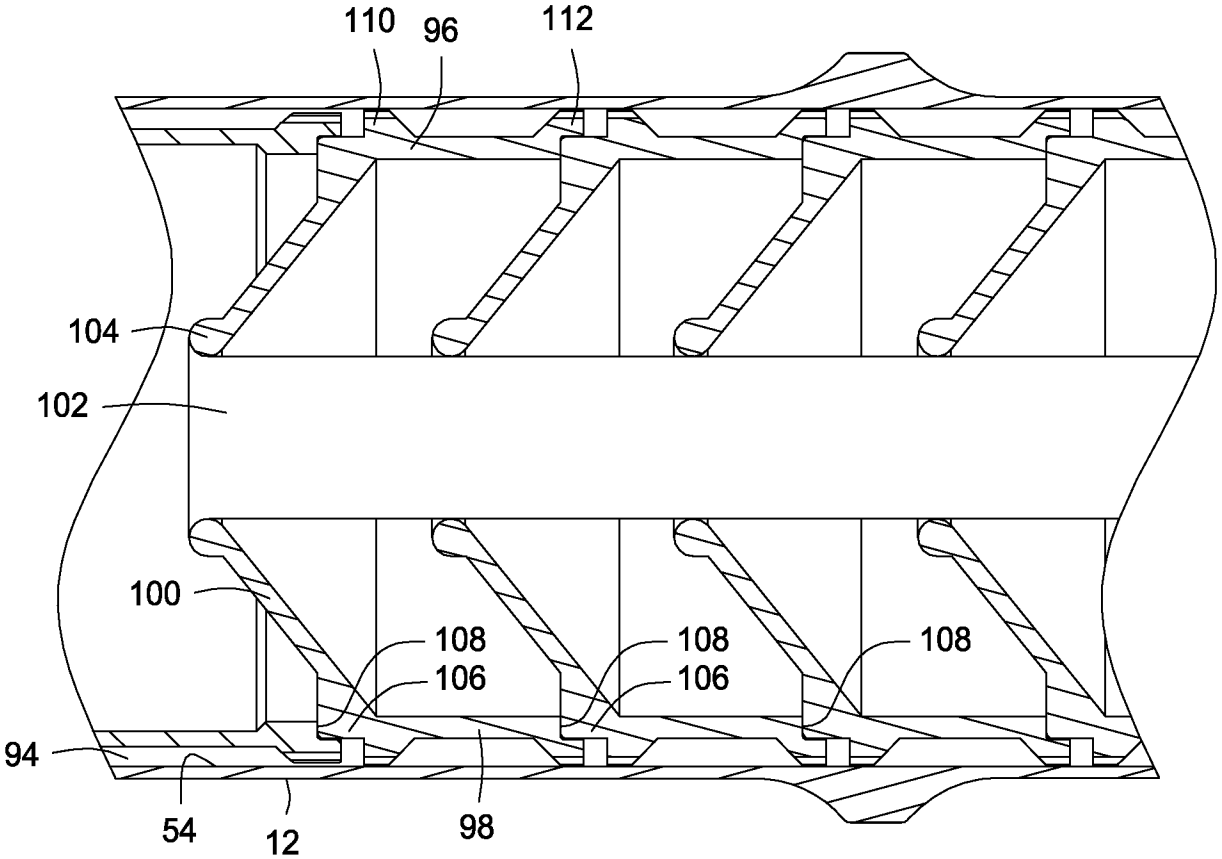
Figure 7:
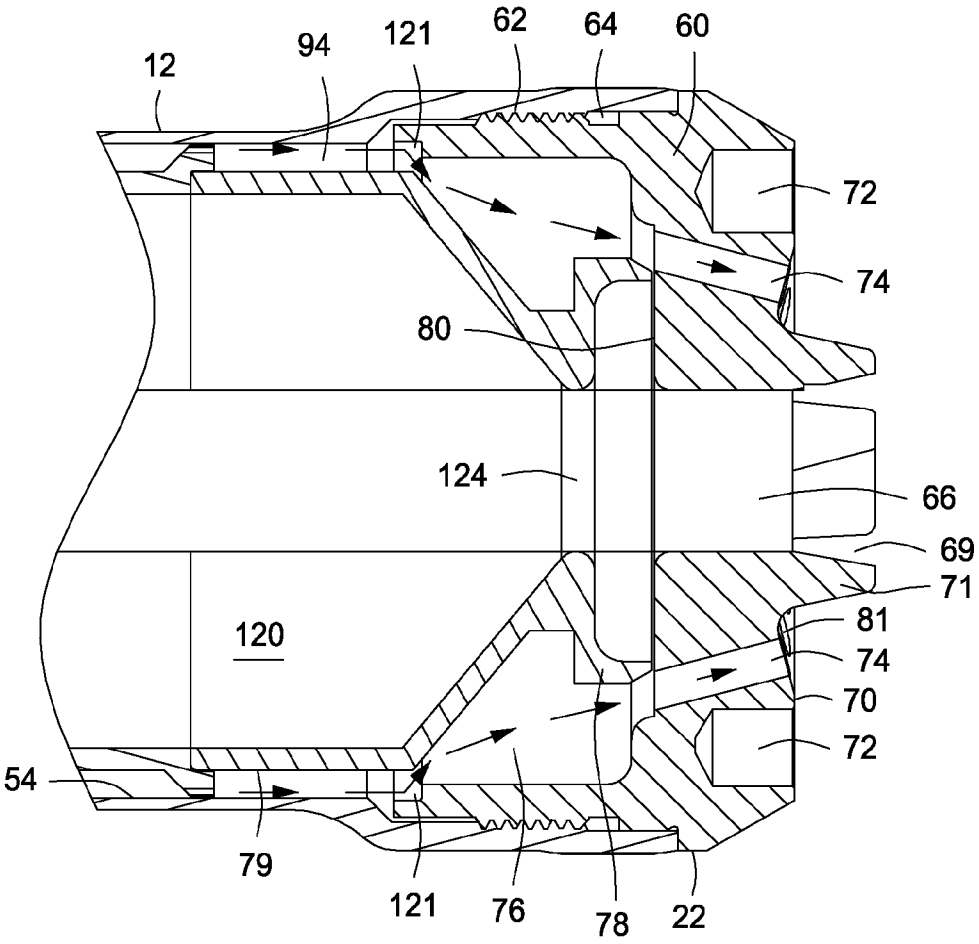

As shown in FIGS. 4, 6 and 9 the propellant gas handling members within the suppressor housing 12 include a number of baffle members 96 that are arranged serially and engage one another in longitudinally stacked relation as shown in FIG. 4. As shown in FIG. 6 each of the baffle members defines a generally cylindrical wall section 98 from which projects a generally conical wall section 100 that defines a central port 102 through which a projectile and propellant gas pass when a cartridge is discharged by the firearm. The central ports 102 are defined by thickened wall sections 104 to minimize the potential for cracking of the conical wall section. At the juncture of the cylindrical wall section 98 and the conical wall section 100 of each propellant gas handling member there is defined an annular seating shoulder 106 that is positioned in engagement within an annular seat recess 108 of an adjacent propellant gas handling member, whether it be a cylindrical spacer member or a similar baffle member. Spaced annular structural rib members 110 and 112 project radially outwardly from the cylindrical wall section and have outwardly projecting spaced positioning members 114 and 116 that project radially outwardly and establish positioning or centering engagement with the inner wall surface 54 of the tubular housing 12. The spaces 115 between the outwardly projecting positioning members 114 and 116 define portions of the secondary flow passage 94.

After a bullet or other projectile passes into the chamber 50 from the bore of the gun barrel 37, propellant gas that has propelled the projectile through the bore of the barrel enters the chamber 50 in the form of a pulse of sharp and sudden explosive energy and ordinarily would develop a loud shot report that is typically accompanied by a bright flash of burning gunpowder that projects a foot or more forwardly of the gun barrel. This pulse of explosive propellant energy within the primary flow path chamber 50 is reflected back into the chamber by the conical wall surface 100 of the first baffle member and causes significant turbulence in the flowing propellant gas. The turbulent propellant gas is then conducted through the flow port 102 of the first baffle member and enters a first baffle chamber 118, with its transition being slowed somewhat and its pressure also being reduced. The conical wall of the second baffle member causes reflection and further turbulence in the propellant gas and further reduces the pressure of the gas as it proceeds through the flow port of the second baffle member and enters a second baffle chamber where the gas is again reflected by a conical baffle wall 199 and agitated. The pressure of the propellant gas is sequentially reduced and its flow is sequentially slowed as the gas proceeds through all of the baffle chambers. From the last baffle chamber the processed propellant gas in the primary flow path 50 passes through a flow port and into a gas concentration chamber 120. From the gas concentration chamber the propellant gas having significantly decreased pressure, is guided by a generally conical gas concentrating wall 122 to a discharge port 124 for discharge from the suppressor via the central discharge port 66. Thus, the velocity of the propellant gas is considerably slowed and its pressure is significantly reduced over a period of time known as "dwell time". During dwell time the gas actuated bolt mechanism of a tactical firearm such as an M-16, M-4 or AR-15 is timed so that it remains closed and locked until the gas pressure within the suppressor and thus within the barrel bore is substantially completely depleted. The bolt member is then cycled by propellant gas energy to extract and eject a spent cartridge case and to pick up a fresh cartridge from a magazine and move it into the cartridge chamber of the firearm in readiness for the firing of a subsequent shot.

The propellant gas handling members within the tubular housing also serve the additional function of containing the explosive pulse of propellant gas energy and thus protecting the relatively thin but high strength wall structure of the tubular housing 12 from being damaged by excessive gas pressure. Though the interfitting joints of the gas handling members, such as the spacer member and baffle members, are not positively sealed the metal to metal fit of the joints is sufficiently good that very little gas leakage occurs from the central chamber 50 during dwell time of suppressor operation. The explosive gas pressure pulse is sufficiently contained by the gas handling members that the wall structure of the tubular housing 12 can be relatively thin and light weight without encountering significant risk of bursting the tubular housing.

An important feature of the present invention is achieved by diverting a significant portion of the high pressure propellant gas discharge from the bore of a firearm barrel to a secondary gas flow passage, thus minimizing the propellant gas pressure and velocity of flow within a primary flow passage. The primary flow passage includes the propellant gas chamber 50 and the baffle chambers and baffle ports and also include the gas flow concentration chamber 120 and central flow port of the front closure member. The secondary flow passage is an annular passage that is defined by the annular space between the exterior of the flow handling members and the interior surface 54 of the tubular housing. One or more flow passage sections 121 are defined at the juncture of the conical wall 122 of the propellant gas concentrating member and the cylindrical wall 123 and are oriented toward the gas discharge openings 74 as shown by flow arrows in FIG. 4 to enhance gas discharge flow from the secondary flow path of the suppressor.

With reference particularly to the enlarged views of FIGS. 4, 6 and 8, it should be noted that the suppressor body 31 defines a forwardly projecting annular extension 126 of reduced diameter which provides support for an annular flange member 128. The reduced diameter extension defines an annular groove 129 that, when closed by the generally cylindrical internal wall surface 54 of tubular housing 12, defines an annular gas diversion chamber 130 as shown in FIG. 4. A generally circular array of gas diversion passages 132 are defined in the annular flange member 128 and are in communication with the internal compartment or chamber 50 and with the annular gas diversion chamber 130. Thus, when propellant gas enters the chamber 50 from the bore of a gun barrel a portion of the propellant gas is diverted through the circular array of gas diversion passages 132 and into the annular gas diversion chamber 130. The annular flange member 128 has an outer periphery that is defined by multiple spaced alignment projections 134 that have aligning engagement with the inner surface 54 of the tubular housing 12. The alignment projections 134 have spaces 136 between them that serve as multiple flow passages externally of the annular flange member, directing diverted propellant gas from the annular gas diversion chamber 130 to the secondary propellant gas flow passage 94. This propellant gas diversion into the secondary flow passage results in diminished gas pressure and volume within the primary gas flow passage and makes the noise suppression quality much quieter. Additionally, the lowered gas pressure minimizes the potential for the appearance of a flash forwardly of the suppressor.

As mentioned above, one of the disadvantages of conventional sound suppressor devices is the difficulty of maintaining precise alignment of a suppressor with respect to the bore of the gun barrel to which it is typically mounted by means of a thread connection. And since most suppressors are mounted to the threaded end or muzzle of a gun barrel by manually threading it to the gun barrel, this threaded mounting connection can easily be loosened by the vibration of firearm use. Obviously a loosened thread connection will cause the suppressor to become misaligned so that a bullet passing through the baffle and exit ports of the suppressor can contact the edges of the ports and cause inaccuracy of shooting or can damage the suppressor to the point that replacement is necessary. As explained above in connection with FIGS. 4, 5 and 6, a flash hider type suppressor mount is securely threaded to the threaded end of the firearm barrel and defines spaced tapered external alignment surfaces 38 and 40 which are engaged by corresponding spaced tapered internal alignment surfaces 39 and 41 within the suppressor body 31. When these internal and external tapered alignment surfaces are maintained in secure engagement the suppressor body 31 will be in precise axial alignment with respect to the bore of the gun barrel.

To maintain the suppressor body 31 in precisely aligned assembly with the suppressor mount and alignment member 30 a collet-like clamp mechanism is provided which is tightened or loosened by manual rotation of a circular retainer cap member 29 that is shown in FIGS. 4 and 8. The suppressor body 31 defines an externally threaded housing mount section 138 which is received by an internally threaded section 140 of the cylindrical rear end section 52 of the tubular housing 12. The suppressor body defines an annular shoulder 142 which is engaged by a circular end or rim 144 of the cylindrical rear end section 52 when the tubular housing has been threaded onto the suppressor body 31 to its maximum extent. An annular seal member 146 is positioned within an external annular seal recess of the suppressor body 31 and maintains a positive pressure resistant seal between the suppressor body and tubular housing. At its rearmost end the suppressor body 31 defines a tapered collet-like structure shown generally at 148 having a circular array of tapered collet-like fingers 150 that are integral with the suppressor body. The collet-like clamping fingers are rendered somewhat flexible by slots 152, leaving the clamping fingers to be supported by relatively small support members 154 that are defined by metal structure on each side of the slots. Each of the clamping fingers defines a tapered cam surface 156 so that the circular array of clamping fingers defines a circular array of tapered cam surfaces. Adjacent the clamping fingers 150 the compressor body 31 defined an externally threaded cap retainer section 158.

The circular retainer cap member 29 defines a knurled outer periphery 160 so that it can be manually gripped when tightening or loosening the retainer cap relative to the suppressor body 31. Internal threads 162 are provided within the retainer cap and are disposed for engagement with the external cap retainer threads 156 of the compressor body. The threads 156 and 162 are preferably left hand threads so that the retainer cap may be tightened by left hand rotation to achieve actuation of a collet-like clamp mechanism for clamping retention of the suppressor body 31 to the suppressor mount 30. The retainer cap member 28 defines an annular internal recess 164 and has one or more pressure relief ports 166 that cooperate with like pressure relief ports 168 that are located within one or more annular external recesses 168 that are defined within an annular external recess 170 of the suppressor body 31. The retainer cap is provided with an internal tapered cam surface 172 that is disposed for camming or actuating engagement with the circular array of tapered collet-like fingers 150 to cause flexing or yielding of the collet-like fingers to establish clamping of the suppressor body 31 to the mounting and alignment member 30. The retainer cap 28 is manually rotated counter-clockwise to cause the internal tapered cam surface to move into engagement with the tapered collet-like fingers 150 and to apply sufficient force to flex or yield the collet-like fingers and establish clamping engagement of the collet-like fingers with the suppressor body. The retainer cap also has a forwardly oriented tapered end surface 29 that serves as a tapered guide surface, minimizing the potential for catching the suppressor on objects like brush, fence wire or the like.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A noise suppressor and flash hider device for mounting to the externally threaded end of a firearm barrel, comprising:

a tubular housing defining an internal housing chamber;

a suppressor mount being connected with the externally threaded section at the muzzle end of a firearm barrel and providing for support and alignment of said tubular housing;

a plurality of propellant gas handling members being located within said elongate tubular housing and defining a primary flow path for propellant gas having a plurality of serially arranged internal propellant gas chambers, said plurality of propellant gas handling members defining spaced projectile ports through which projectiles and propellant gas pass, said tubular housing and said plurality of propellant gas handling members defining primary and secondary propellant gas flow paths within said tubular housing;

said tubular housing having a front wall structure defining a projectile and propellant gas exit port in communication with said primary propellant gas flow path and defining a propellant gas exhaust port in communication with said secondary propellant gas flow path;

said front wall defining a front wall surface and having a plurality of propellant gas exhaust passages each in communication with said secondary propellant flow path and having passage exhaust openings at said front wall surface; and said plurality of propellant gas exhaust passages being of angulated orientation and having exhaust ports arranged in a substantially circular array and directing propellant gas exhaust from said secondary flow path to converge with propellant gas being discharged from said projectile and propellant gas exit port.

2. The noise suppressor and flash hider device of claim 1, comprising:

said primary propellant flow path being defined within said tubular housing and internally of said plurality of propellant gas handling members; and said secondary propellant gas flow path being defined within said tubular housing and externally of said plurality of propellant gas handling members.

3. The noise suppressor and flash hider device of claim 1, comprising:

said tubular housing defining an internal wall surface; and a plurality of propellant gas handling members being located within said tubular housing and having external surfaces disposed in spaced relation with said internal wall surface and defining said secondary flow path, said propellant gas handling members being of generally tubular configuration and defining said primary flow path therein.

4. The noise suppressor and flash hider device of claim 1, comprising:

said tubular housing being an integral tubular member having a generally cylindrical housing wall defining a generally cylindrical internal housing wall surface;

annular structural rib members projecting outwardly from said tubular housing and having smoothly curved fillets merging with said tubular housing; front and rear housing sections extending from said tubular housing and having internal left hand thread connections; a front wall member having left hand threaded connection with said internal thread connection of said front housing section; and a suppressor body member having left hand threaded connection with said internal thread connection of said rear housing section.

5. The noise suppressor and flash hider device of claim 4, comprising:

said suppressor body member having a longitudinal passage therein and having a body extension forming an annular gas transfer groove in communication with said secondary flow path and defining a plurality of gas transfer passages communicating said primary flow path with said annular gas transfer groove; and wherein a portion of propellant gas discharged from the muzzle end of a firearm barrel is transferred via said plurality of gas transfer passages and said annular gas transfer groove to said secondary flow path from said primary flow path, thus minimizing propellant gas pressure and flow within said primary flow path and minimizing gun powder flash forwardly of said suppressor by permitting sufficient suppressor dwell time for complete burning of gun powder within said suppressor.

6. The noise suppressor and flash hider device of claim 5, comprising:

a longitudinal passage being defined by said suppressor body member;

a pair of internal sealing and suppressor alignment surfaces being defined within said longitudinal passage; and a suppressor mount adapted for threaded attachment to a firearm barrel and having a pair of external sealing and suppressor alignment surfaces disposed in sealing engagement with said pair of internal sealing and suppressor alignment surfaces;

a collet-like clamping member having an annular array of clamping fingers being provided on said suppressor body member and having clamping relation with said suppressor mount; and a cap member having threaded attachment with said suppressor body member and having a clamp actuating surface actuating said annular array of clamping fingers upon being threaded to said suppressor body member.

7. The noise suppressor and flash hider device of claim 6, comprising:

said suppressor mount member having a tubular wall having lateral gas ports in communication with said primary flow path and defining an internal chamber having a transverse wall having a propellant gas and projectile port centrally thereof;

an extension being defined by said suppressor mount member and having a plurality of spaced transverse walls each having a propellant gas and projectile port centrally thereof; and said extension defining lateral gas exhaust ports between said plurality of spaced transverse walls and in communication with said primary flow path.

8. The noise suppressor and flash hider device of claim 1, comprising:

said plurality of propellant gas handling members including a tubular spacer member, a plurality of baffle members and a propellant gas concentration member;

said plurality of propellant gas handling members having tubular sections defining seat recesses and seat shoulders that interfit to form a longitudinal internal propellant gas handling structure within said tubular housing; and external ribs being defined by said plurality of propellant gas handling members and having positioning contact with said internal surface of said tubular housing, said external ribs having external slots that define flow passages internally of said tubular housing and externally of said longitudinal internal propellant gas handling structure, said external slots being portions of said secondary flow path.

9. The noise suppressor and flash hider device of claim 8, comprising:

gas transfer openings being defined in said longitudinal internal propellant gas handling structure and being in communication with said primary and secondary flow paths and being of a dimension and location causing transfer of desired gas pressure and flow from said primary flow path to said secondary flow path.

10. The noise suppressor and flash hider device of claim 1, comprising:

said suppressor mount having a barrel mount section defining said internally threaded section and having an externally tapered surface and an externally threaded section; and said suppressor mount having a housing mount section being secured to said elongate tubular housing and having an internally tapered surface disposed in aligning engagement with said externally tapered surface and having an internally threaded section in retaining engagement with said externally threaded section.

11. The noise suppressor and flash hider device of claim 1, comprising:

said suppressor mount having a barrel mount section having spaced externally tapered surfaces and an externally threaded section between said spaced externally tapered surfaces;

said suppressor mount having a housing mount section being secured to said rear extremity of said elongate tubular housing and having spaced internally tapered surfaces disposed in aligning engagement with said spaced externally tapered surfaces and having an internally threaded section in retaining engagement with said externally threaded section; and wherein said barrel mount and said housing mount are axially aligned by said housing mount and said barrel mount and maintain coaxial alignment of said noise suppressor and flash hider device with the firearm barrel to which it is attached.

12. The noise suppressor and flash hider device of claim 1, comprising:

a housing mount section of said suppressor mount and said elongate tubular housing defining a secondary gas collection chamber receiving propellant gas from said primary gas flow path and being in propellant gas conducting relation with said secondary propellant gas flow path.

13. The noise suppressor and flash hider device of claim 12, comprising:

said housing mount section of said suppressor mount having a plurality of propellant gas passages extending rearwardly from said primary gas flow path to said secondary gas collection chamber.

14. The noise suppressor and flash hider device of claim 1, comprising:

a tapered gas concentration member being located within said elongate tubular housing and having a projectile port centrally thereof, said tapered gas concentration member defining an annular secondary gas chamber within said elongate tubular housing in communication with said secondary flow path;

a projectile exit port being defined centrally of said front wall;

an external generally circular contoured groove being defined by said front wall about said projectile exit port; and a plurality of propellant gas exhaust passages extending through said front wall and having outlet openings within said external generally circular contoured groove, said plurality of propellant gas exhaust passages being in communication with said annular secondary gas chamber.

15. The noise suppressor and flash hider device of claim 1, comprising:

said elongate tubular housing having a front end portion and a rear end portion;

a front closure member having threaded connection within said front end portion of said elongate tubular housing and having a front wall structure having a central projectile and propellant gas exhaust port in communication with said primary flow path and a plurality of angulated propellant gas exhaust ports disposed about said central projectile and propellant gas exhaust port in communication with said secondary flow path; and a suppressor body having threaded connection within said rear end portion of said elongate tubular housing and having a generally circular array of collet-like clamping fingers; and a retainer cap having threaded connection with said suppressor body and having a clamp actuating surface engaging and deflecting said collet-like clamping to clamping positions with said suppressor mount and alignment member.

16. The noise suppressor and flash hider device of claim 15, comprising:

said threaded connections of said front closure member, said suppressor body and said retainer cap each having left handed threads.

17. A noise suppressor and flash hider device for mounting to the externally threaded end of a firearm barrel, comprising:

an elongate tubular housing defining front and rear extremities and having a generally cylindrical internal housing surface; a suppressor mount being located at said rear extremity of said elongate tubular housing and having an internally threaded section receiving the externally threaded section of a firearm barrel;

a plurality of gas handling members being located within said elongate tubular housing and defining a primary flow path for propellant gas and defining a plurality of serially arranged internal propellant gas chambers, said baffle members each having an aligned projectile port through which projectiles move and through which propellant gas also flows, said baffle members each having an outer generally cylindrical wall disposed in circumferentially spaced relation with said internal housing surface and defining a generally cylindrical secondary flow path for propellant gas;

a front wall being mounted to said elongate tubular housing and defining a projectile and propellant gas exit port centrally thereof, said front wall defining a generally annular array of propellant gas exhaust ports surrounding said projectile and propellant gas exit port and being in communication with said secondary flow path and exhausting propellant gas from said secondary flow path through said front wall;

said front wall defining a front wall surface and having a plurality of propellant gas exhaust passes of angulated orientation each being in communication with said secondary propellant flow path and having propellant gas exhaust openings at said front wall surface;

a generally circular contoured depression being defined by said front wall and being located about said projectile and primary exhaust gas port; and said plurality of propellant gas exhaust passages being of angulated orientation and having exhaust ports arranged in a substantially circular array within said generally circular contoured depression and directing propellant gas exhaust from said secondary flow path to converge with propellant gas being discharged from said projectile and propellant gas exit port.

18. The noise suppressor and flash hider device of claim 17, comprising:

said suppressor mount having a barrel mount section defining axially spaced externally tapered surfaces of different diameter and an externally threaded section between said axially spaced externally tapered surfaces;

said suppressor mount having a housing mount section being secured to said rear extremity of said elongate tubular housing and having axially spaced internally tapered surfaces disposed in aligning engagement with said axially spaced externally tapered surfaces and having an internally threaded section in retaining engagement with said externally threaded section; and wherein said barrel mount and said housing mount are axially aligned by said housing mount and said barrel mount and maintain coaxial alignment of said noise suppressor and flash hider device with the firearm barrel to which it is attached.

19. The noise suppressor and flash hider device of claim 17, comprising:

said housing mount section of said suppressor mount and said elongate tubular housing defining a secondary gas collection chamber receiving propellant gas from said primary gas flow path and being in propellant gas conducting relation with said secondary propellant gas flow path; and said housing mount section of said suppressor mount having a plurality of propellant gas passages extending rearwardly from said primary gas flow path to said secondary gas collection chamber.

20. The noise suppressor and flash hider device of claim 17, comprising:

a tapered gas concentration member being located within said elongate tubular housing and having a projectile port centrally thereof, said tapered gas concentration member defining an annular secondary gas chamber within said elongate tubular housing in communication with said secondary flow path;

a projectile exit port being defined centrally of said front wall;

an external generally circular contoured groove being defined by said front wall about said projectile exit port; and a plurality of propellant gas exhaust passages extending through said front wall and having outlet openings within said external generally circular contoured groove, said plurality of propellant gas exhaust passages being in communication with said annular secondary gas chamber.

21. The noise suppressor and flash hider device of claim 17, comprising:

said elongate tubular housing having a front end portion and a rear end portion;

a front closure member having left threaded connection within said front end portion of said elongate tubular housing and having a front wall structure having a central projectile and propellant gas exhaust port in communication with said primary flow path and a plurality of angulated propellant gas exhaust ports disposed about said central projectile and propellant gas exhaust port in communication with said secondary flow path; and a suppressor body having left handed threaded connection within said rear end portion of said elongate tubular housing and having a generally circular array of collet-like clamping fingers; and a retainer cap having left handed threaded connection with said suppressor body and having a clamp actuating surface engaging and deflecting said collet-like clamping to clamping positions with said suppressor mount and alignment member.

22. A method for handling movement of a projectile and propellant gas within a noise and flash hider device mounted to the barrel of a firearm, comprising:

providing a tubular suppressor housing being supported and aligned with a bore of a rifle barrel by a suppressor mount and having a plurality of generally tubular propellant gas handling members located in longitudinally stacked relation within said tubular suppressor housing and having a plurality of aligned projectile ports defining parts of a primary flow path within said propellant gas handling members;

maintaining said generally tubular propellant gas handling members in spaced and centralized relation within tubular suppressor housing and defining a secondary flow path between said tubular suppressor housing and said plurality of generally tubular propellant gas handling members;

providing a gas transfer path in communication with said primary and secondary flow paths;

permitting passage of a projectile discharged from the barrel of the firearm through said aligned projectile ports; receiving propellant gas from said firearm barrel into said primary flow path; transferring a portion of said propellant gas from said primary flow path to said secondary flow path;

discharging propellant gas from said primary and secondary flow paths via primary and secondary propellant gas discharge openings of said suppressor housing;

containing propellant gas flow within said primary and secondary flow paths by means of a front wall member having a front wall surface having a primary projectile and propellant gas discharge port centrally thereof in communication with said primary flow path and a plurality of secondary propellant gas discharge ports of said front wall surface in communication with said secondary flow path; and orienting said plurality of propellant gas exhaust passages at an angle and arranging exhaust ports in a substantially circular array and directing propellant gas exhaust from said secondary flow path to converge with propellant gas being discharged from said projectile and propellant gas exit port.

* * * * *